US005865683A

United States Patent [19]

Yang

[11] Patent Number: 5,865,683

[45] Date of Patent: Feb. 2, 1999

[54] SIMPLIFIED GOLF PRACTICE EQUIPMENT

[76] Inventor: Kuan-Chou Yang, No. 6, Lane 83, Cheng Chow Road, Ta-Tung Dist., Taipei, Taiwan

[21] Appl. No.: 8,312

[22] Filed: Jan. 16, 1998

[51] Int. Cl.[6] ..... A63B 69/36

[52] U.S. Cl. ..... 473/147; 473/139

[58] Field of Search ..... 473/139, 140, 473/142, 145, 146, 147, 149

[56] References Cited

U.S. PATENT DOCUMENTS

| | | | |
|---|---|---|---|
| 1,847,570 | 3/1932 | McLaughlin | 473/147 |
| 3,325,169 | 6/1967 | MacKniesh | 473/140 |
| 4,522,406 | 6/1985 | Tarquinio | 473/147 |
| 5,255,920 | 10/1993 | Mangeri | 473/140 |
| 5,577,964 | 11/1996 | Chen | 473/145 |
| 5,700,203 | 12/1997 | Sheih | 473/147 |

*Primary Examiner*—Steven Wong
*Attorney, Agent, or Firm*—Rosenberg, Klein & Bilker

[57] ABSTRACT

A simplified golf practice equipment is sampled to four bare parts only which comprises a rectangular base block, an "L" shaped metal supporting plate mounted on one side of the base block by nuts, a steel cantilever shaft having one end fixed to a vertical slot of the vertical portion of the supporting plate by a nut and a ball swinging rod having a mounting socket at the top for sleeving over the free end of the cantilever shaft and retained by a nut and a washer, and a target ball at a free end of the ball swinging rod and all the nuts are simplified of uniform size.

5 Claims, 6 Drawing Sheets

SIMPLIFIED GOLF PRACTICE EQUIPMENT

FILED OF THE INVENTION

The present invention relates to a simplified golf practice equipment, and more particularly relates to a simplified golf practice equipment which is easy to assemble or disassemble simply.

BACKGROUND OF THE INVENTION

The present invention relates to a simplified golf practice equipment which comprises only four bare parts of heavy duty including a rectangular base block, an "L" shaped supporting plate, a cantilever shaft and a ball swinging rod without any miscellaneous parts to minimize the damage of the equipment, and more particularly to a simplified golf practice equipment which is easy to assemble or disassemble simply by fastening or loosing four uniform nuts. Therefore, only one spanner or wrench is needed.

Golf practice equipment have been developed, but each of those prior arts has some drawbacks. The structure of the prior arts are complicated with a number of small parts, and most of those conventional equipments for outdoor practice need considerable large space enclosed by net. Some prior arts are designed for indoor practice by providing a target ball which is fastened by a cable or a rope. However, the weight of those equipment is not heavy enough that they lack of stability, and the entire equipment might slip away and hit something in the surrounding.

SUMMARY OF THE INVENTION

The present invention has been accomplished to provide a simplified golf practice equipment which eliminates the aforesaid problems. It is one object of the present invention to provide a simplified golf practice equipment which comprises only four bare parts of heavy duty, therefore it can avoid the damage due to the vulnerable miscellaneous parts.

It is another object of the present invention to provide a simplified golf practice equipment which is easy to assemble and disassemble by working to a group of uniform nuts.

BRIEF DESCRIPTION OF THE DRAWINGS

The present invention can be better understood by detailed descriptions of the follow drawings, in which.

DETAILED DESCRIPTION OF THE PREFERRED EMBODIMENT

Figure 1:
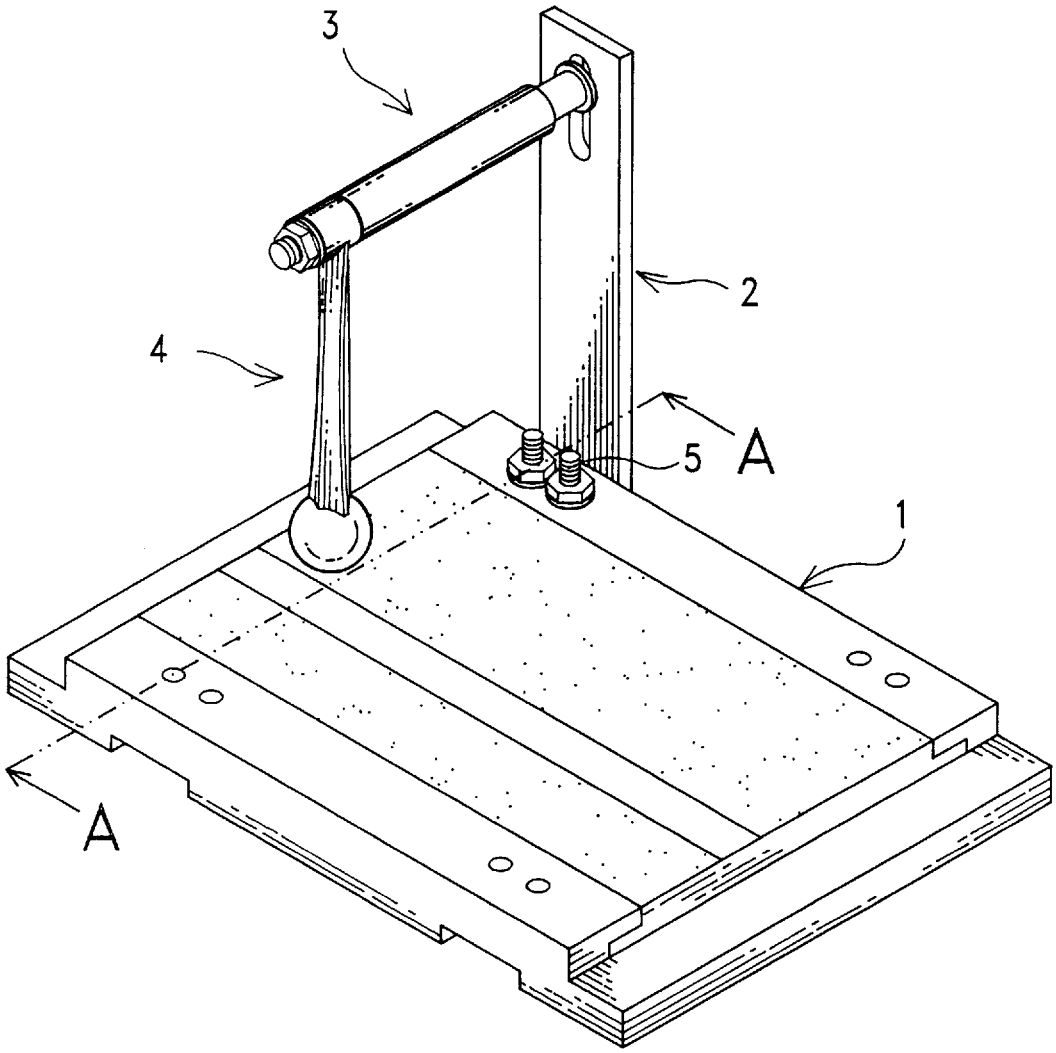
FIG. 1 is a perspective view of a preferred embodiment according to the present invention.
Figure 1A:
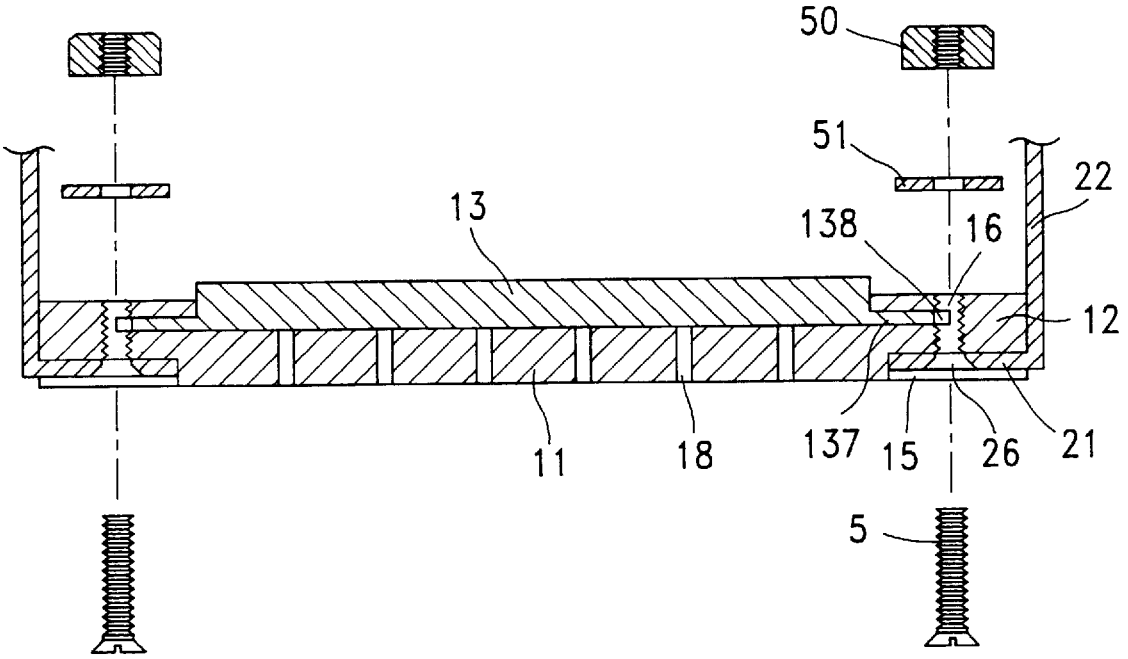
FIG. 1A is a sectional view according to A—A section line of FIG. 1.
Figure 2:
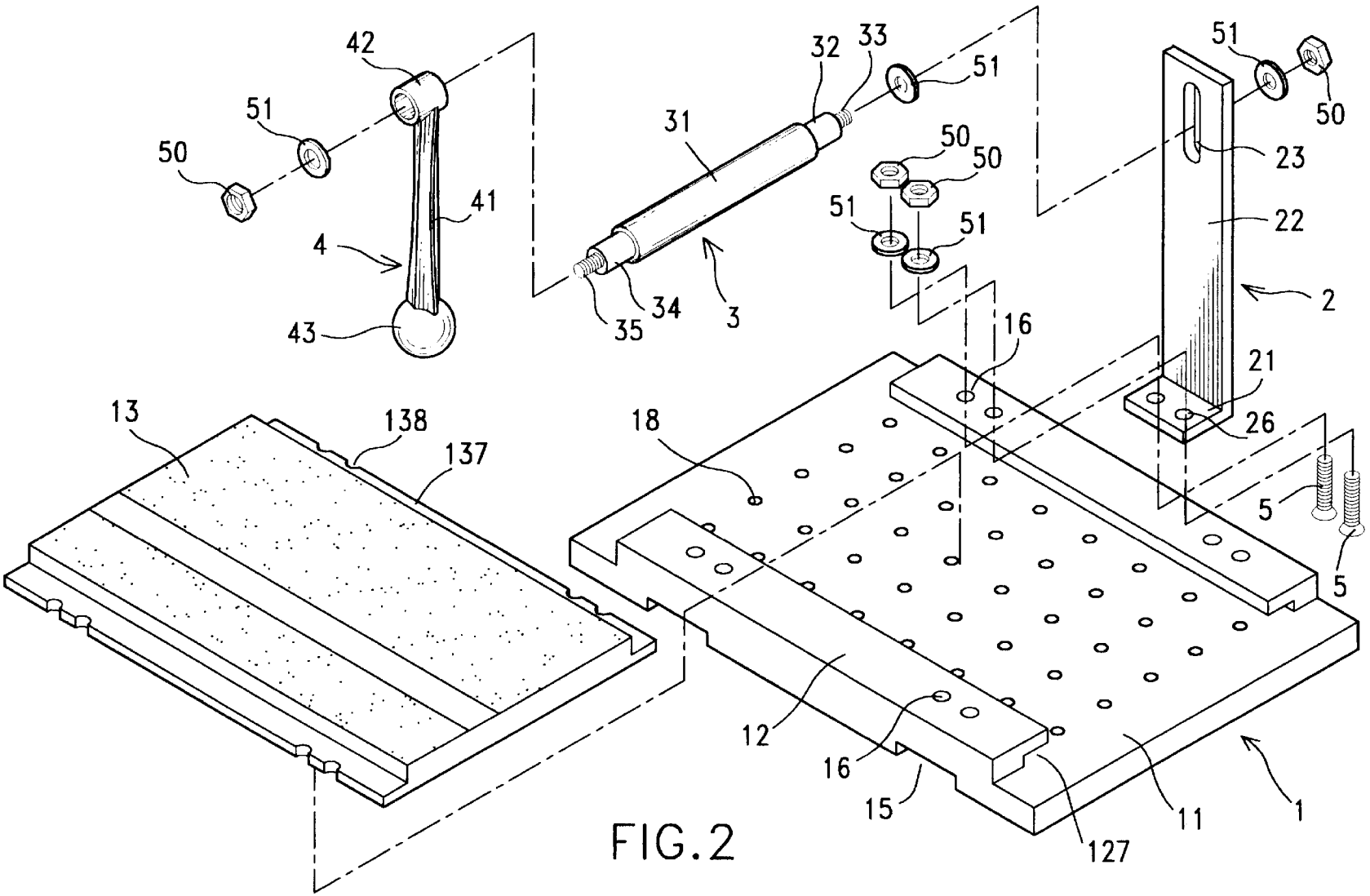
FIG. 2 is a explosive view of FIG. 1.

Please refer to FIG. 1, FIG. 1A, and FIG. 2, a simplified golf practice equipment according to the present invention comprised a rectangular base block 1, an "L" shaped metal supporting plate 2, a steel cantilever shaft 3 and a ball swinging rod 4. The base block 1 comprises a rectangular heavy bottom plate 11 of certain thickness for maintain the stability of the equipment having two upward flanges 12 disposed on two opposite longitudinal side with a respective inner slot 127 longitudinally disposed under each flange 12, a rectangular artificial turf sheet 13 covered on the base plate 11 between the flanges 12 having two base flanges 137 of solid, material extend from the bottom of two opposite longitudinal side for inserting into the inner slots 127 under the flanges 12 so as easy to replace a new sheet 13 if necessary, two notched mounting space 15 disposed under each flange 12 respectively at a position which is about one fourth of the whole length of the flange 12 from either end thereof to provide a choice of a adequate position to install the "L" shaped supporting plate 2 suitable for a right-hand player or a left-hand player therefor, at least two mounting holes 16 disposed on each mounting space 15 respectively for receiving a sink head bolt 5 inserted upwardly during assembly, two groups of half-rounded notches 138 disposed to each base flange 137 of the artificial turf sheet 13 respectively corresponding to the mounting holes 16 of the notched mounting space 15 of the base block 1; while the artificial turf sheet 13 is inserted into the space between the longitudinal flanges 12 covered on the bottom plate 11 by sliding the base flanges 137 into the inner slots 127 in place under the flanges 12 during assembly, the half-rounded notches 138 then will be caught by the mounting bolts 5; therefore it is easy to replace a new artificial turf sheet 13 if needed; a plurality of ventilation holes 18 disposed on the bottom plate 11 for keeping the artificial turf sheet 13 in dry condition.

The "L" shaped supporting plate 2 comprises a horizontal portion 21 having at least two sink headed holes 26 corresponding to the mounting holes 16 of the notched mounting space 15 of the base block 1 respectively receiving a sink-head bolt 5 inserted from the bottom and fastened by a nut 50, a vertical portion 22 having a mounting slots 23 disposed vertically around a center near the top for mounting the cantilever shaft 3 thereon.

The steel cantilever shaft 3 is formed of a shaft body 31 having a first reduced neck 32 and a first thread head 33 disposed to a fixing end, and a second neck 34 and a second thread head 35 disposed to a free end, which the first reduced neck 32 is held in the vertical slot 23 of the supporting plate 2 for adjusting the height of the cantilever shaft 3 and fastened by a nut 50 and washers 51 onto the first thread head 33, while the second reduced neck 34 and the thread head 35 are provided for mounting the ball swinging rod 4 there on.

The ball swinging rod 4 is formed of a rod body 41 having a mounting socket 42 disposed to one end and a target ball 43 disposed to the opposite free end, which the mounting socket 42 is pivoted on the second reduced neck 34 of the cantilever shaft 3 and retained by a nut 50 and washers 51 onto the second thread head 35.

All the screw threads including the thread heads 33 and 35 of the cantilever shaft 3 and the bolts 5 are simplified of uniform size with same specification, therefore only one kind of nuts 50 being used in the present invention.

Figure 3:
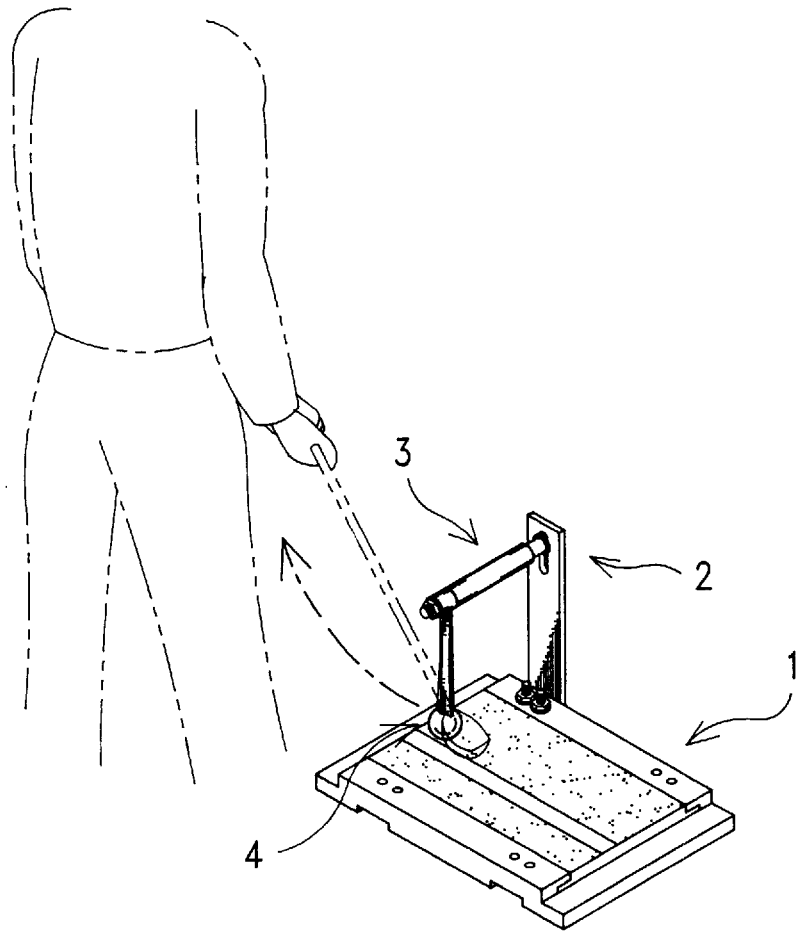
FIG. 3 is a perspective view showing a practice taken by a right-hand golf player.

Please refer to FIG. 3, a right-hand golf player swings the golf club to hit the target ball 41 of the ball swinging rod 4. The ball swinging rod 4 will spin after hitting the target ball 41. The golf player can hit the target ball 41 again after the ball swinging rod 4 stopped spinning.

Figure 4:
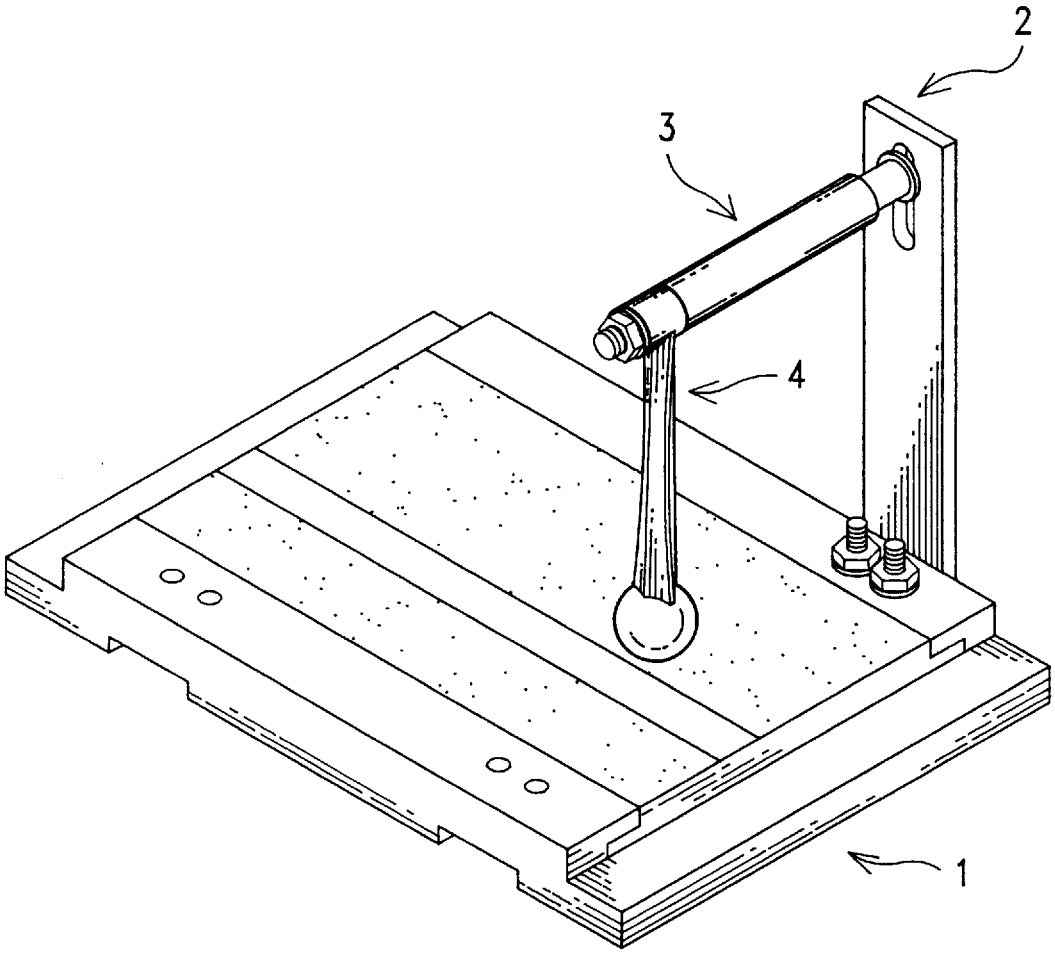
FIG. 4 shows the equipment assembled for a left-hand golf player.

Please refer to FIG. 4, the present invention is showing a practice for a left-hand golf player. The "L" shaped metal supporting plate 2 has been mounted onto another notched mounting space 15 of the base block 1 for a left-hand golf player.

Figure 5:
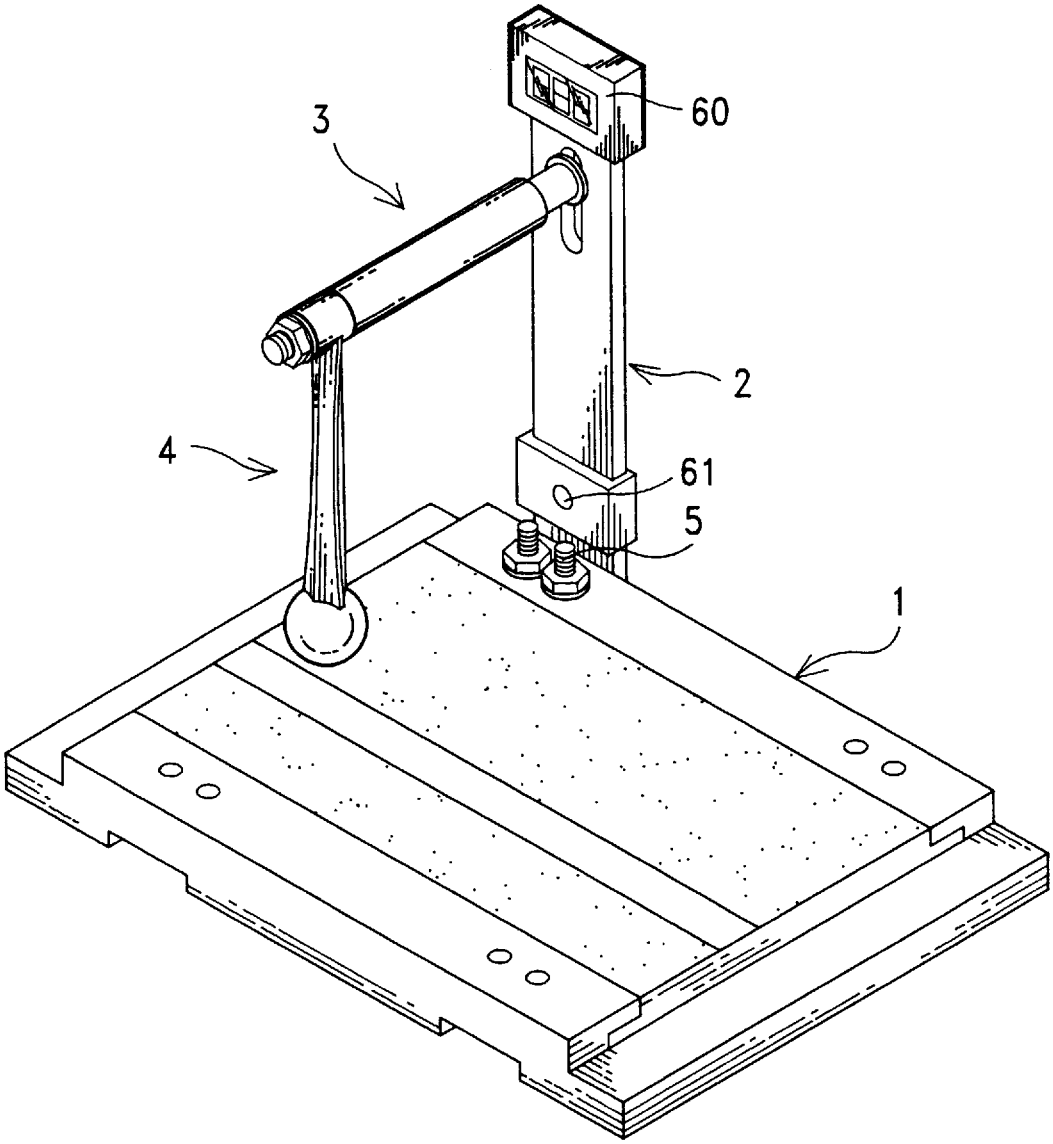
FIG. 5 shows another embodiment in which a speed sensor and a range meter have been employed in the present invention.

Please refer to FIG. 5, which has an additional range meter 60 and a speed detector 61 mounted on the "L" shaped metal supporting plate 2. The speed detector 61 has a photo sensor disposed at a lower side of the "L" shaped metal supporting plate 2 alined with the target ball 41 so that it can detect the initial velocity of the hitting ball 41 and transmit the signal to an estimate range in yards showing at the range meter 60, the golf player can adjust his stroke of hitting during the practice.

It is to be understood that the drawings are designed for purposes of illustration only, and are not intended as a definition of the limits and scope of the invention disclosed.

What the invention claimed is:

1. A simplified golf practice equipment comprises only four parts including a heavy base block, an L-shaped metal supporting plate, a steel cantilever shaft and a ball swinging rod;

said base block comprising a rectangular bottom plate of a predetermined thickness having two longitudinal flanges raised from two opposite longitudinal sides thereof for guiding a rectangular artificial turn sheet fixed firmly therein, two notched mounting spaces respectively disposed under each of said longitudinal flanges for providing a choice of said mounting space to install said L-shaped supporting plate thereon;

said L-shaped metal supporting plate comprising a shorter horizontal portion having at least two sink head through holes corresponding to said mounting holes of said notched mounting space for firmly installing said supporting plate onto said notched mounting space of said base block by sink-head bolts and nuts, a longer vertical portion having a vertical mounting slot centrally disposed adjacent a top portion thereof for mounting said steel cantilever shaft and adjustment thereof to a suitable height thereunto;

said steel cantilever shaft having a first reduced neck and a first thread head disposed on a fixing end thereof for insertion into said vertical mounting slot of said vertical portion of said L-shaped supporting plate and fixed by a nut and washers during assembly, a second reduced neck and a second thread head disposed on an opposite end for mounting said ball swinging rod thereon;

said ball swinging rod having a rod body, a mounting socket disposed at one end of said rod body for pivoting around said second reduced neck of said cantilever shaft and retained in place by a nut and washers, a target ball provided on an opposite free end of said rod body.

2. The simplified golf practice equipment according to claim 1 wherein said thread heads of said cantilever shaft and said mounting bolts are of a uniform size and specification.

3. The simplified golf practice equipment according to claim 1 wherein said notched mounting spaces are provided to easily change the position of said L-shaped supporting plate for right-hand player or left-hand player.

4. The simplified golf practice equipment according to claim 1 wherein said rectangular bottom plate has a plurality of ventilation holes under said artificial turf sheet for substantially maintaining a dry condition thereof.

5. A simplified golf practice equipment according to claim 1, wherein a range meter and a speed detector can be mounted on said L-shaped metal supporting plate for detecting an initial velocity of said target ball and transmitting a signal to said range meter for display of an estimated range in yards.

* * * * *